US006270041B1

(12) United States Patent
Helas et al.

(10) Patent No.: US 6,270,041 B1
(45) Date of Patent: Aug. 7, 2001

(54) METHOD FOR LOCKING MOVEABLE POINT SECTIONS

(75) Inventors: Wolfgang Helas; Jens Meinecke, both of Bielefeld; Günter Worm, Paderborn, all of (DE)

(73) Assignee: Hanning & Kahl GmbH & Co., Oerlinghausen (DE)

( * ) Notice: Subject to any disclaimer, the term of this patent is extended or adjusted under 35 U.S.C. 154(b) by 0 days.

(21) Appl. No.: 09/423,998

(22) PCT Filed: May 29, 1998

(86) PCT No.: PCT/EP98/03210

§ 371 Date: Nov. 17, 1999

§ 102(e) Date: Nov. 17, 1999

(87) PCT Pub. No.: WO98/54042

PCT Pub. Date: Dec. 3, 1998

(30) Foreign Application Priority Data

May 30, 1997 (DE) ..... 297 09 420 U

(51) Int. Cl.[7] ..... B61L 7/04

(52) U.S. Cl. ..... 246/448; 246/449; 246/450; 246/451; 246/452

(58) Field of Search ..... 246/448, 449, 246/450, 451, 452

(56) References Cited

U.S. PATENT DOCUMENTS 2,906,477 9/1959 Ueda ..... 246/318
5,292,091 * 3/1994 Callegari et al. ..... 246/258

FOREIGN PATENT DOCUMENTS 2928194 10/1980 (DE) .
0467865 1/1992 (EP) .
0467865 A1 * 1/1992 (EP) ..... B61L/5/10
WO9411578 5/1994 (WO) .
WO9427853 12/1994 (WO) .
WO-9427853-A1 * 12/1994 (WO) ..... B61L/5/02

* cited by examiner

*Primary Examiner*—S. Joseph Morano
*Assistant Examiner*—Frantz F. Jules
(74) *Attorney, Agent, or Firm*—Richard M. Goldberg

(57) ABSTRACT

An apparatus for mechanically locking the end positions of movable point sections, with two adjusting rods (12, 14 ), each of which is connected with one of the point sections and which are coupled mechanically with one another, with at least one locking tappet (28) for locking the adjusting rods in each case in one of their end positions and a force limiting device, which cancels the locking, when the force, exerted by the point sections on the adjusting rods, exceeds a certain value, and the force limiting device is formed by a coupling device (30, 32), which yields when stressed and is located between the adjusting rods (12, 14), and by a transfer mechanism (16, 38), which converts the movement of one of the adjusting rods into a movement for unlocking the locking tappet (28).

12 Claims, 4 Drawing Sheets

METHOD FOR LOCKING MOVEABLE POINT SECTIONS

BACKGROUND OF THE INVENTION

The invention relates to an apparatus for mechanically locking the end positions of movable point sections, with two adjusting rods, each of which is connected with one of the point sections and which are coupled mechanically with one another, with at least one locking tappet for locking the adjusting rods in each case in one of their end positions and a force limiting device, which cancels the locking, when the force, exerted by the point sections on the adjusting rods, exceeds a certain value. In particular, the invention relates to an apparatus for locking the points of streetcar rails.

In the case of point section devices, it is important that the movable point sections are held securely in their respective end position. When a vehicle runs over a facing point, that is, when the wheels of the rail-bounded vehicle first run on the free ends of the points, the one switch rail, the so-called closed switch rail, must lie tightly against the continuous rail, while the other switch rail, the so-called open switch rail, must be at a sufficient distance from the associated continuous rail, so that the wheels can safely pass through the shunt and the rail-bound vehicle is not damaged or derailed. On the other hand, when a certain force is exceeded, the points must be able to yield, so that the rails of the rail-bound vehicle can yield laterally, when the point is passed trailing and the rail is not in the correct position. In the case of points that can be forced, the points in such a case remain in the new position, in which they have been set, that is, the shunt is shifted by the wheels of the rail-bound vehicle.

Shunt-adjusting devices are known, for which the adjusting rods for adjusting the two points are uncoupled mechanically and actuated in each case directly by the driving mechanism of the adjusting device and locked by respective locking clamps (such as clamp point locks). The contacting switch rail is locked rigidly, for example, against a rigid rail, while the remote switch rail is held by the self-locking or fixable driving mechanism. This arrangement has the advantage that the contacting switch rail can be held in its end position with a force, which is significantly larger than that holding the remote switch rail. The relatively high cost of the construction is, however, a disadvantage. In addition, the driving mechanism cannot be changed over manually with an adjustment plate and, when the point is forced, the adjustment rods are separated from the driving mechanism, so that the driving mechanism must be actively tracked into the new shunt position, so that the points are ready to function once again.

From practical experience, an adjusting device of the type named above is known (Hanning & Kahl HW 60 AW adjusting device), for which the two adjusting rods are coupled mechanically. The housing of the adjusting device preferably is disposed centrally between the two points, and the mutually coaxial adjusting rods enter the housing from opposite sides. Within the housing, the adjusting rods are rigidly connected with one another by a connecting piece. The locking tappet is disposed pivotably at the connecting piece and acts, on the one hand, with a locking plate, coupled with the driving mechanism of the adjusting device, and, on the other, with the force limiting device, disposed in the housing. Due to the force limiting device, both switch rails are held in the respective end position with the same force. If this force is exceeded when the points are forced, the force limiting device yields, the lock is unlocked and the shunt is shifted into the new position, in which the locking is brought about once again with the help of the locking tappet.

SUMMARY OF THE INVENTION

It is an object of the invention to provide a device of the type named above, for which, in every end position, one of the two movable point sections (the closed switch rail) can be held with a larger force.

Pursuant to the invention, this objective is accomplished owing to the fact that the force limiting device is formed by a coupling device, which yields when stressed and is located between the adjusting rods, and by a transfer mechanism, which converts the movement of one of the adjusting rods into a movement for unlocking the locking tappet.

The force holding one of the movable point sections is limited by the force limiting device. In practice, this shunt part usually is the open switch rail. The adjusting rod for the closed switch rail, on the other hand, is locked at the housing with the help of the locking tappet with a theoretically unlimited force. When the point is forced, this locking is canceled only when the open switch rail was deflected somewhat and, as a result, the associated adjusting rod is moved. The holding force can also be larger than the force required to adjust the shunt. Without decreasing the holding force, the adjusting device can therefore be designed so it can easily be changed over manually or with the help of a driving mechanism, which need not be self-locking.

In a special embodiment, the locking tappet is held movably at a connecting piece, and the coupling device acts between the connecting piece and each of the adjusting rods and yields in each case only when the adjusting rod is stressed in one direction.

In the case of an adjusting device disposed between the points, the two adjusting rods preferably are disposed coaxially to one another and the connecting piece lies within the housing of the adjusting device between the free ends of the adjusting rods, so that it supports the adjusting rods rigidly. Coupling elements are then disposed so that they yield, when the associated adjusting rod is pulled out of the housing with a sufficiently large force.

The coupling elements may be formed, for example, by springs, force-limiting couplings, clamping elements and the like.

The transfer mechanism preferably is formed by a locking plate, which embraces catches fastened to the free ends of the adjusting rods and has a locking contour for the locking tappet held at the connecting piece.

For a different embodiment, preferably two locking tappets are held immovably in the direction of motion of the adjusting rods at a part of the apparatus, fastened to the housing, and movable in a direction perpendicularly thereto between a locking position, in which they lock the adjusting rods positively, and an unlocking position, which releases the adjusting rods.

This solution has the advantage that the locking of the adjusting rods, instead of taking place indirectly over a connecting piece, takes place directly at the housing of the apparatus and is based not on self-inhibiting effects, but on positive locking. By these means, a high functional reliability is achieved and the position, in which the adjusting rods are locked, can be defined precisely and, if necessary, adjusted. When two locking tappets are used, the two adjusting rods can also be adjusted independently.

Preferably, the locking tappets are constructed as ledges, which extend transversely to the adjusting rods and are supported sliding over inclined surfaces or by means of roll bodies on unlocking ledges, which extend parallel to the adjusting rods and can be moved in the longitudinal direction of the latter. The locking tappets then carry out strictly a translational movement during the locking and unlocking processes. This arrangement is particularly advantageous if the locking device is used in combination with a testing device, which scans the position of the switch rail with the help of test rods disposed parallel to the adjusting rods. The locking tappets of the locking device can then extend into the testing device and function there also for locking the test rods, so that additional safety is attained. The locking tappets then fall into the locking position only if the adjusting rods, as well as the test rods, are in the correct position. By scanning the position of the locking tappets, a signal can thus be obtained, which connects the locked status of the adjusting device by a logical AND with the status signal of the testing device.

The unlocking ledges, which interact with the closing tappets, preferably are fastened to a carriage, which is guided in the housing parallel to the adjusting rods and engages the carriage of the actuating drive. The function of this carriage thus is comparable to the function of the locking plate of the embodiment described first.

The locking plate or the carriage can be held in the housing by a tensioning mechanism, which has a dead center in the middle position of the locking plate and prestresses the locking plate elastically on either side of the dead center into the respective end position. Since the locking plate is coupled mechanically with the adjusting rods by means of the catch, the tensioning mechanism ensures that the adjusting rods, after overcoming the dead center, are transferred automatically into the respective end position. The shunt can therefore be changed over very simply with the help of an adjusting mechanism engaging the locking plate. The adjusting mechanism can be actuated, for example, manually, magnetically, by motor, hydraulically or pneumatically.

Due to the tensioning mechanism, the positively held contacting closed switch rail is additionally pressed elastically against the associated rail. The holding force for the open switch rail is composed additively of the force of the coupling element and the force of the tensioning mechanism.

BRIEF DESCRIPTION OF THE DRAWINGS

Preferred examples are described in greater detail in the following by means of the drawing, in which.

DETAILED DESCRIPTION

Figure 1:
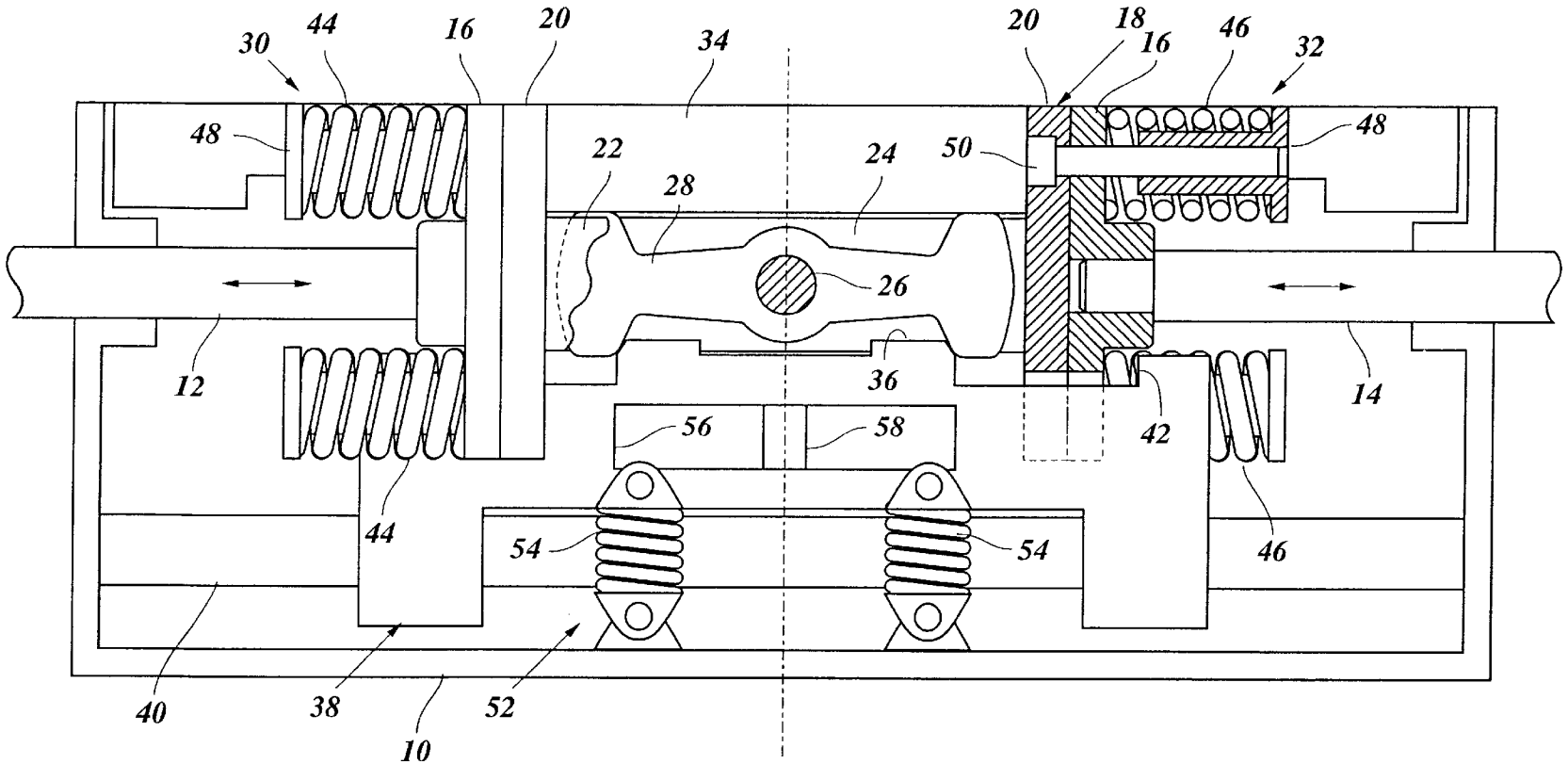
FIG. 1 shows a partially sectional view of a first embodiment of the inventive device.

FIG. 1 shows an open half shell of a housing 10 of a shunt adjusting apparatus, which is disposed centrally between two points, which are not shown. Two adjusting rods 12 and 14, which are coaxial to one another, are connected with one of the points and enter the housing 10 from opposite sides. A catch 16 is fastened to the free end of each adjusting rod.

Between the two catches 16, a connecting piece 18 is inserted which, at each end, has an end plate 20, which is supported at the associated catch. The two end plates 20 are connected by upper and lower cross members 22 and 24, through which an axle 26, which is shown in section in the drawing, passes. A locking tappet 28, which has approximately the shape of a double ax, is held between the upper and lower cross members 22, 24 rotatably on the axle 26.

The adjusting rods 12 and 14 and the connecting piece 18 are held together by coupling devices 30, 32, which are mounted on the outside of the catches 16. The adjusting rods 12 and 14, the connecting piece 18 with the locking tappet 28 and the coupling devices 30, 32 can thus be shifted as a unit along the common axis of the adjusting rods 12, 14, as indicated by the double arrows in FIG. 1. In this connection, the locking tappet 28 is guided on one side (at the top in FIG. 1) by a guiding ledge 34 that is attached to the housing.

On the opposite side (at the bottom in FIG. 1), the locking tappet 28 engages a locking contour 36 of a locking plate 38, which in turn is guided on a guiding rod 40 attached to the housing. On each side, the locking plate 38 forms a stop 42 for the outer surface of the catch 16. In FIG. 1, only the stop 42 on the right side can be recognized.

The coupling devices 30 and 32 are formed in each case by four springs 44, 46, which are disposed symmetrically about the common axis of the adjusting rods 12, 14. In the direction of viewing, the two springs 44 on the left side in FIG. 1 lie above the locking plate 38, while on the right side in FIG. 1, the two springs 46, of which one is shown in section and which lie below the locking plate, can be recognized. The springs 44, 46 are supported in each case with one end at the catch 16 and, with the other end, at a spring plate 48, which is connected by a bolt 50 rigidly with the end plate 20 of the connecting piece 18. The guiding ledge 34 is embraced in fork fashion by the end plates 20 and the parts of the catches 16 adjoining the end plates 20.

The locking plate 38 is connected elastically by a tensioning mechanism 52 with the housing 10. The tensioning mechanism is formed by two or, as in the example shown, by four springs 54 (compression springs), of which only two can be recognized in FIG. 1. The springs 54 are in each case held with one end pivotally at a wall of the housing 10 and, at the other end, connected pivotally with the locking plate 38. In the middle position of the symmetrically constructed shunt adjusting device shown in FIGS. 1 and 2, the springs 54 are compressed elastically in their dead center position.

In one opening 56 of the locking plate, a shaft 58 is disposed, which is connected rigidly with the locking plate and which can be engaged by an actuating drive, which is not shown and with which the locking plate 38 and, with that, also the adjusting rods 12, 14 can be shifted, in order to bring the points into their end positions.

Figure 2:
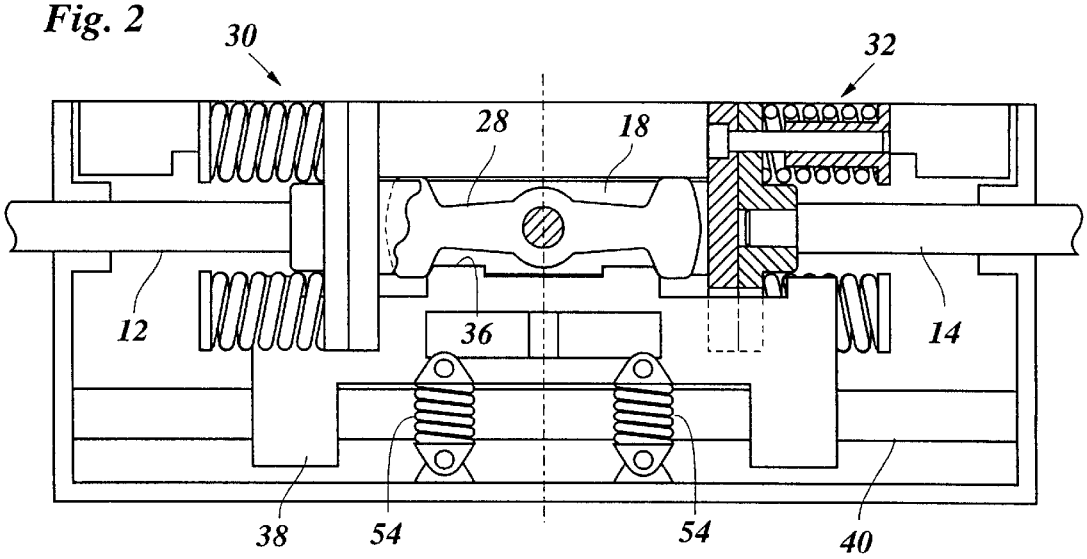
FIGS. 2 to 4 show views of the device of FIG. 1 in a middle position, an end position and in the initial phase while the point is being forced.
Figure 3:
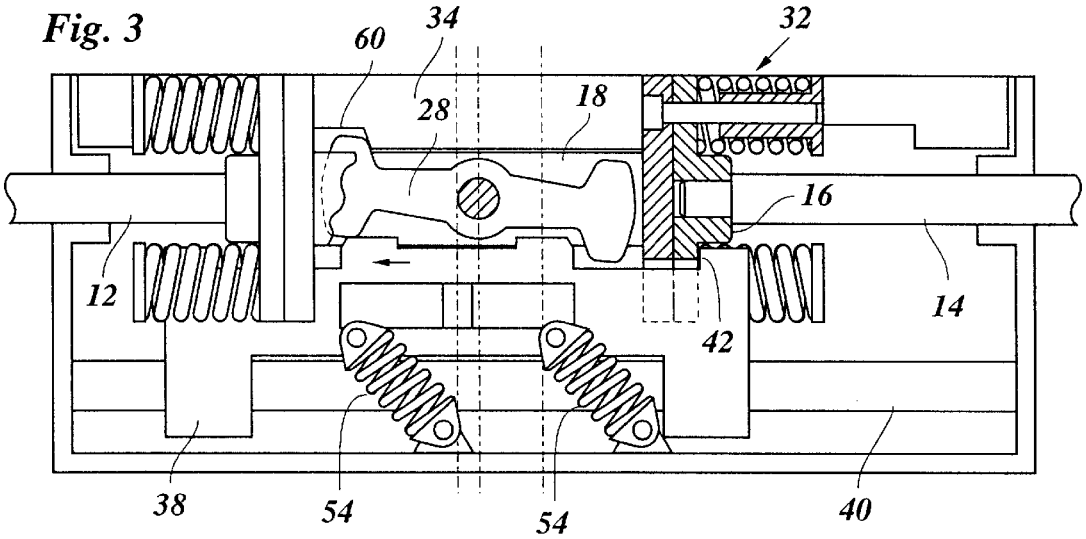

If, for example, the locking plate 38 is moved with the help of the actuating drive out of the position shown in FIGS. 1 and 2 somewhat to the left, the compressed springs 54 are swiveled out of the dead center position and push the locking plate 38 along the guiding rod 40 further to the left as can be seen in FIG. 3. In the initial phase of this movement (FIG. 2), the locking contour 36 of the locking plate engages the locking tappet 28, so that the locking tappet and the connecting piece 18 also move to the left, until the locking tappet 28 falls into a recess 60 of the guiding ledge 34 (FIG. 3). The locking plate 38 alone then moves further and, with its locking contour 36, locks the locking tappet 28 in the recess 60.

The adjusting rod 12 is shifted to the left by the connecting piece 18, so that the associated point is brought into contact with the rail. This point then is the closed switch rail. Since the connecting piece 18 is locked in the position shown in FIG. 3 by the locking tappet 28 and the locking contour 36 is locked at the guiding ledge 34, which is connected with the housing, the closed switch rail also is locked rigidly in its position.

If the locking plate 38, under the action of the springs 54 alone, moves further to the left, the stop 42 on the right side comes into contact with the catch 16 there. The force of the spring 54 then acts over the catch and the connecting piece 18 on the left adjusting rod 12, so that the closed switch rail is additionally prestressed elastically in the closed position. By these means, any clearance between the closed switch rail and the rail is eliminated and, due to the rigid mechanical locking, the closed switch rail is secured in its position with a theoretically unlimited holding force.

The point, connected with the right adjusting rod 14, is tightened by the above-described process initially by the force of the coupling device 32 and is then held in the end phase (FIG. 3) in the open position additionally by the force of the springs 54. The holding force corresponds to the sum of the forces of the coupling device 32 and the springs 54. Since the coupling device 32 is formed by a total of four springs 44, 46, a high holding force is achieved even if one of these springs were to break.

However, if the shunt is changed over manually, it is only necessary to overcome the force of the springs 54 until these springs have passed over their dead center. By means of the appropriate movement of the locking plate 38, the locking tappet 28 is unlocked, the connecting piece 18 is then carried along to the right in the drawing and finally the springs 54 bring about the further movement of the adjusting rods and the locking in the opposite end position. At the same time, the thickened right end of the locking tappet 28 falls into a recess of the guiding ledge 34, which cannot be recognized in the drawing and corresponds to the recess 60.

Figure 4:
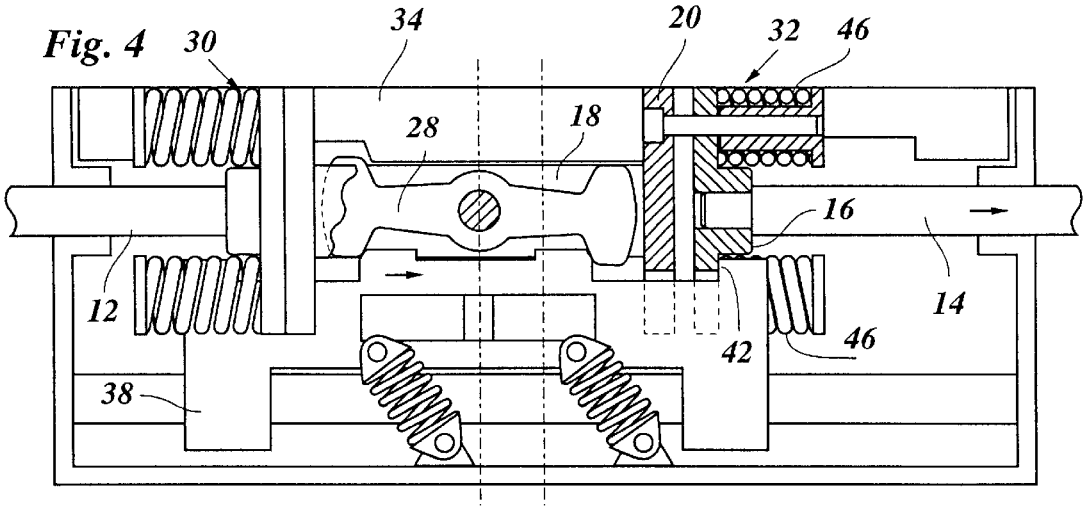

FIG. 4 illustrates the course of the movement in the event that the point is forced by the rail-bound vehicle. The closed switch rail, which is connected with the adjusting rod 12, initially remains locked in the closed position. The open switch rail is deflected by the wheels of the rail-bound vehicle and pulls the adjusting rod 14 against the force of the coupling device 32 to the right, so that the catch 16, which is connected with this adjusting rod 14, is detached from the associated end plate of the connecting part 18, as can be seen in FIG. 4. Since this catch 16 is up against the stop 42, the connecting plate 38 is carried along toward the right, so that the locking tappet 28 is released. The tension on the springs of the coupling device 32 can then be released, so that the connecting piece 18 is pulled along to the right. Due to the force of the left coupling device 30, the adjusting rod 12 is carried along with this movement. As soon as the springs 54 have passed over their dead center, the shunt is changed over in the manner already described and locked once again. The actuating drive, coupled with the locking plate 38, is carried along into the new position and is therefore ready to make adjustments once again immediately.

The holding force for the open switch rail can be adjusted, in that the pretension of the springs 44 and 46 is varied with the help of the bolt 50, screwed into the spring plate 48.

FIGS. 5 to 8 illustrate the principle of functioning of a device of a second example.

Figure 5:
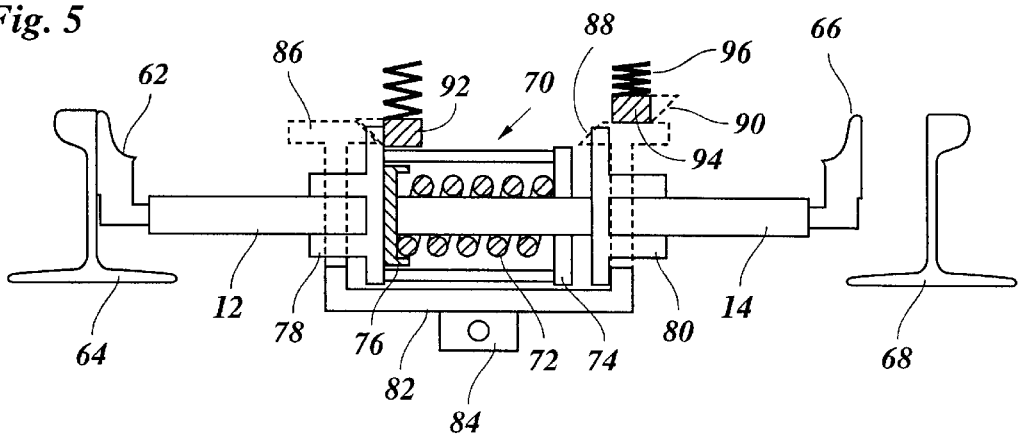
FIGS. 5 to 8 show diagrammatic sketches to explain the mode of functioning of the device of a second embodiment and FIG. 9 shows a diagrammatic outline of the device of FIGS. 5 to 8.

In FIG. 5, a closed switch rail 62 can be recognized, which is held at the free end of the adjusting rod 12 and lies against a rail 64, as well as an open switch rail 66, which is held at the free end of the adjusting rod 14 and lies at a distance from the associated rail 68.

The adjusting rods 12, 14 are connected to one another by a coupling device 70, which yields when stressed in tension. The coupling device 70 has a spring assembly or a spring 72, which is supported with one end at the bottom of a cage 74 fastened to the adjusting rod 12 and, with the other end, at a spring plate 76, fastened to the adjusting rod 14.

Each of the adjusting rods 12, 14 is connected axially rigidly with an associated connecting fork 78 or 80. The two connecting forks 78, 80 are embraced with some clearance by a carriage 82, which can be moved in the longitudinal direction of the adjusting rods 12, 14 and is connected over a coupling 84 with the actuating drive, which is not shown. The carriage 82 carries unlocking ledges 86, which interact over inclined surfaces 88 with corresponding inclined surfaces 90 of two locking tappets 92, 94, which lie transversely to the locking ledges. The locking tappets 92, 94 can be moved vertically with the help of guides, which are not shown, in a housing or frame of the apparatus, which is not shown, and prestressed elastically with the help of springs 96 into a locked position, in which they secure the associated connecting fork 78 or 80 and, with that, the associated adjusting rod positively against an inwardly directed axial movement.

In FIG. 5, the locking tappet 92, belonging to the adjusting rod 12, is in the locked position, so that the closed switch rail 62 is locked positively in its position. The locking tappet 94, on the other hand, is in the unlocked position, in which it lies on a flat section of the unlocking ledge 86. The open switch rail 66 can therefore move against the force of the spring 72 in the direction of the rail 68 and is thus held in its position only by the holding force of this spring.

Figure 6:
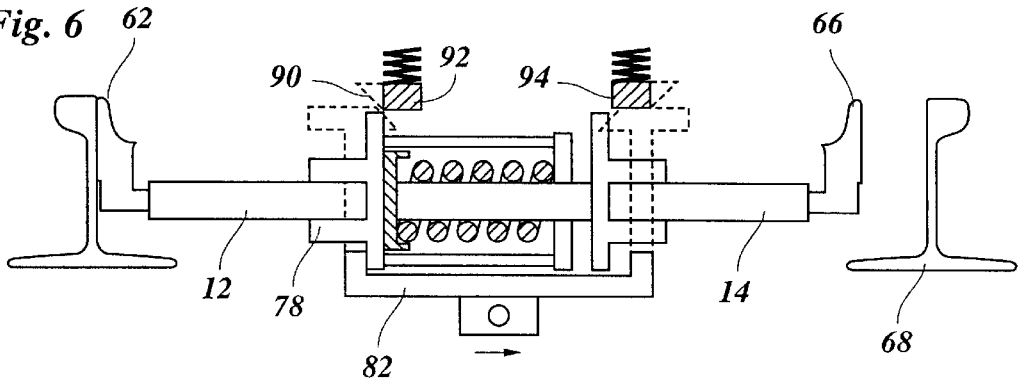
Figure 7:
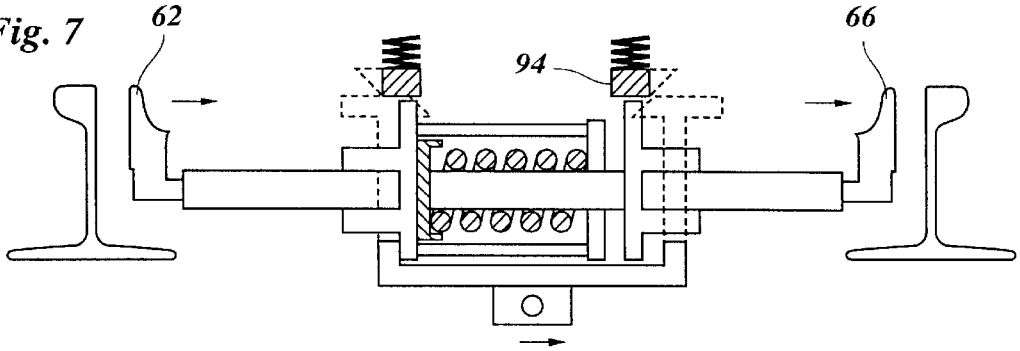

FIG. 6 illustrates the initial phase of a shunt adjustment process, for which the carriage 82 is moved with the help of the driving mechanism mentioned towards the right in the direction of the rail 68. Since there is a certain clearance between the carriage 82 and the connecting forks 78, 80 and the connecting fork 78 is locked by the locking tappet 92, the connecting forks initially do not participate in the movement of the carriage 82. The unlocking ledges 86 therefore slide with their inclined surfaces on the corresponding inclined surfaces 90 of the locking tappet 92 and move this counter to the force of the spring 96 into the unlocked position. As soon as the carriage 82 comes up against the connecting fork 78, the two adjusting rods 12, 14 move jointly with the carriage 82 further towards the right, as shown in FIG. 7.

At the end of the adjusting process, if the switch rail 66 has become the closed switch rail and the switch rail 62 the open switch rail, the locking tappet 94 falls into the locking position, so that the switch rail 66 is locked. The state, then achieved, is the mirror image of the state in FIG. 5. In a similar manner, the shunt can then be restored once again to the position shown in FIG. 5.

Figure 8:
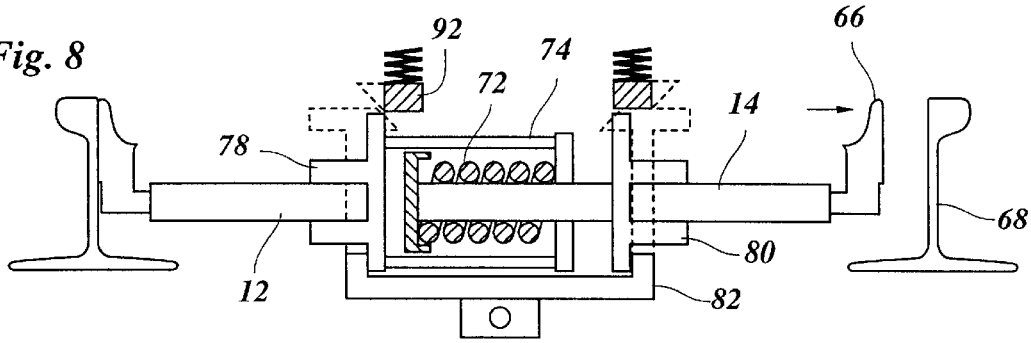

FIG. 8 illustrates the initial phase of a forcing process, by means of which the point can be forced by a rail-bound vehicle. The open switch rail 66 is forced by the wheels of the rail-bound vehicle against the rail 68. Because of the clearance between the carriage 82 and the connecting fork 80, the adjusting rod 14 can move towards the right. At the same time, the spring 72 is compressed, since the cage 74 and the connecting fork 78 are locked at the locking tappet 92. Because of the relative motion between the carriage 82 and the locking tappet 92, this locking, however, is canceled, so that both adjusting rods 12, 14 can move jointly with the carriage 82 into the new position. At the end of the forcing process, the shunt, as in the case of a normal adjusting process, is locked with the help of the locking tappet 94.

Figure 9:
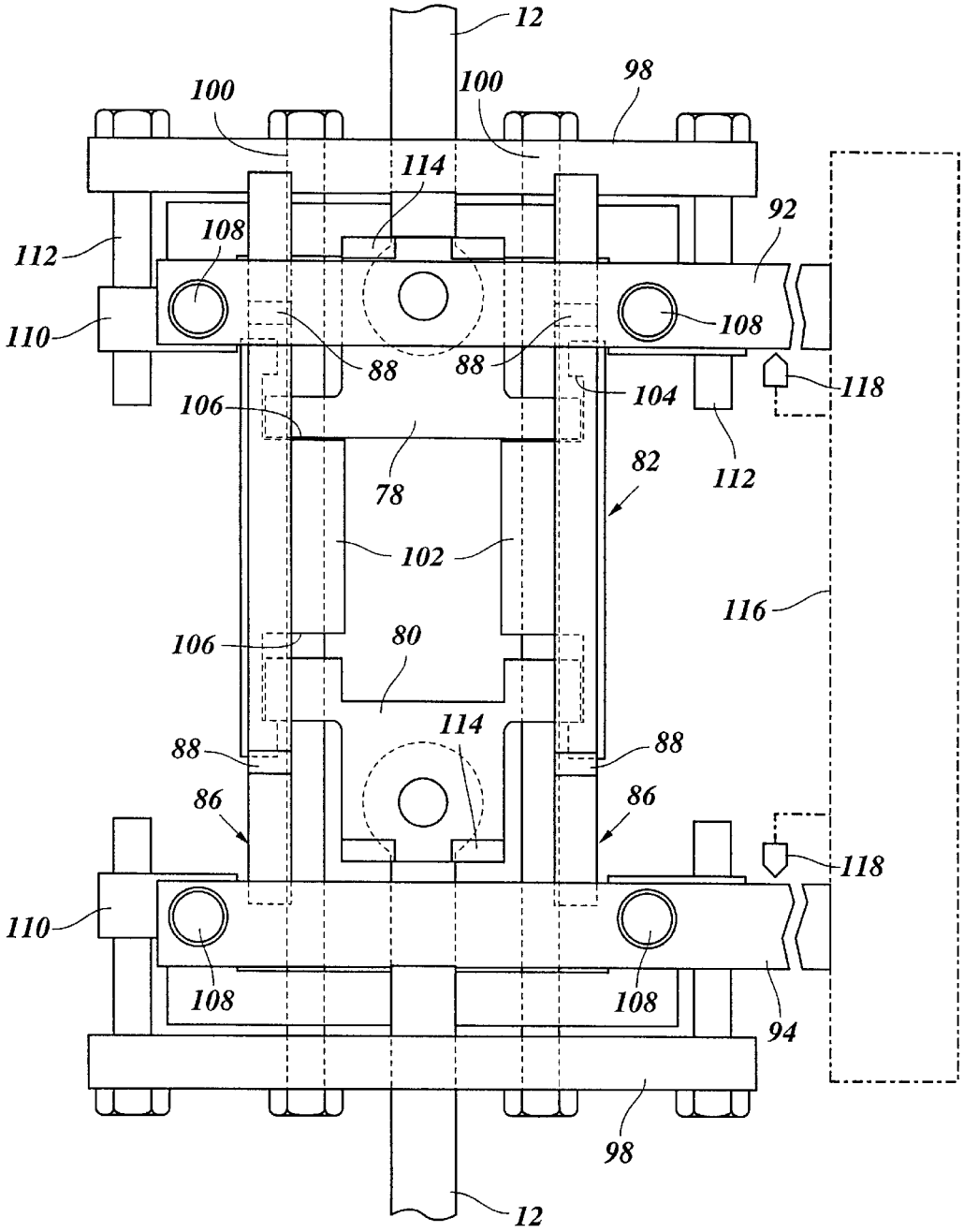

FIG. 9 illustrates a possible construction of the apparatus, which works according to the principle shown in FIGS. 5 to 8. The state, shown in FIG. 9, corresponds to the state of FIG. 5, in which the switch rail, which is connected with the adjusting rod 12, is the closed switch rail.

The whole of the apparatus is mounted between two frame plates 98 which, in relation to the rails 64, 68 are disposed rigidly in a housing not shown. The carriage 82 runs on guiding rods 100, which extend between the frame plates 98. The carriage 82 has two parts 102 here, which are the mirror image of one another and are connected together by transporting plates, which are not shown and, at the same time, form parts of the coupling for the actuating drive. The connecting forks 78 and 80 are also guided on the guiding rods 100. Furthermore, it can be seen in FIG. 9 that the clearance of the connecting forks 78 and 80 relative to the carriage 82 is limited in both directions by stop surfaces 104 and 106.

Each of the two parts 102 of the carriage 82 carries an unlocking ledge 86 which, on the upper side, has two oppositely inclined surfaces 88. The two locking tappets 92 and 94 lie transversely over the locking ledge 86 and are guided, so that they cannot tilt, each on two vertical guiding bolts 108. The two guiding bolts 108 for each locking tappet are fastened on a locking seat 110, which is held adjustably on rods 112 extending parallel to the guiding rods 100. The rods 112 are fastened in each case to one of the frame plates 98.

In FIG. 9, the connecting tappet 92 is in the lowered locking position, in which it lies at cams 114 of the connecting fork 78, locking them. The inclined surfaces 90 of the locking tappet 92 lie in a manner, which cannot be seen in FIG. 9, at the underside of the locking tappet and contact the inclined surfaces 88 of the unlocking ledge.

The locking tappet 94 lies on the ends of the unlocking ledges 86, which are the lower ends in FIG. 9, and is held thereby in a raised unlocking position, so that the cams 114 of the connecting fork 80 can pass underneath the locking piece 94.

During an adjusting process, the carriage 82 and the connecting ledge 86 in FIG. 9 move downward, so that the locking tappet 92 is raised by the inclined surfaces 88 into the unlocking position. If the locking is canceled, the locking fork 78 is carried along by the stop surfaces 104 and the connecting fork 80 is carried along by the stop surfaces 106 of the carriage. If the lower inclined surfaces 88 of the two locking ledges 86 reach the inclined surfaces 90 of the locking tappet 94, the locking tappet 94 falls into the locking position behind (in FIG. 9 above) the cam 114 of the connecting fork 80.

By adjusting the locking seats 110 on the rods 112, the locked positions of the connecting forks and the adjusting rods 12, 14 can be adjusted independently of one another.

In FIG. 9, a test device 116 is indicated diagrammatically. It is disposed next to the locking device between the points and functions, in a known manner, for checking the positions of the points. The checking takes place with the help of test rods, which are not shown and are connected in an appropriate manner, like the adjusting rods 12, 14, with the points. The locking tappets 92 and 94 are elongated to one side in such a manner, that they extend into the test device 116. The advantageous possibility of locking the test rods in an appropriate manner, like the adjusting rods 12, 14, with the help of the locking tappets 92 and 94, arises out of this. The vertical positions of the locking tappets 92 and 94 can be scanned with the help of probes 118. If, during a shunt adjusting process, as a result of the breakage of an adjusting rod, for example, the adjusting rods are moved into the new position, but the associated point is not, then the corresponding test rod remains in the original position and prevents the locking tappets 92 and 94 from falling into the locking position. Accordingly, the signals of the probes 118 indicate not only whether the adjusting rods were locked in the intended position, but also whether the shifting of the point is confirmed by an appropriate movement of the test rods.

For reasons of greater clarity, the coupling device 70, acting between the connecting forks 78 and 80, is not shown in FIG. 9.

The driving mechanism for the carriage 82 can, as for the embodiment of FIGS. 1 to 4, be equipped with a tensioning mechanism 52. Alternatively, however, a different suitable type of driving mechanism can also be used.

What is claimed is:

1. An apparatus for mechanically locking the end positions of first and second movable point sections, with first and second adjusting rods, with the first adjusting rod connected with the first point section and the second adjusting rod connected with the second point section, and the first and second adjusting rods coupled mechanically with one another, comprising:

a) at least one locking tappet for locking the adjusting rods in each case in one end position thereof, and b) a force limiting device, which cancels the locking, when a force, exerted by the point sections on the adjusting rods, exceeds a certain value, the force limiting device including:

i) at least one coupling device which yields when stressed and is connected for movement with the adjusting rods, and ii) a transfer mechanism which converts movement of one of the first and second adjusting rods into a movement for unlocking the at least one locking tappet.

2. The apparatus of claim 1, a) further comprising a connecting piece, and b) wherein:

i) the at least one locking tappet is held movably at the connecting piece, ii) the at least one coupling device includes a first coupling device that acts on the first adjusting rod via the connecting piece and yields only when stressed in one direction and a second coupling device that acts on the second adjusting rod via the connecting piece and yields only when stressed in an opposite direction, and iii) the transfer mechanism converts relative movement between the adjusting rods and the connecting piece into the unlocking movement.

3. The apparatus of claim 1, wherein there are two said locking tappets held immovably in the direction of movement of the adjusting rods at a part of the apparatus, said two locking tappets being fastened to the housing and being movable in a direction perpendicularly to said direction of movement between a locking position, in which the two locking tappets lock the adjusting rods positively, and an unlocking position, which releases the adjusting rods.

4. The apparatus of claim 3, wherein the transfer mechanism has at least one unlocking ledge which extends parallel to the adjusting rods, is movable in a longitudinal direction thereof over inclined surfaces, and interacts with the locking tappets extending transversely to the locking ledges.

5. An apparatus for mechanically locking the end positions of first and second movable point sections, with first and second adjusting rods, with the first adjusting rod connected with the first point section and the second adjusting rod connected with the second point section, and the first and second adjusting rods coupled mechanically with one another, comprising:

a) at least one locking tappet for locking the adjusting rods in each case in one end position thereof, b) a force limiting device, which cancels the locking, when a force, exerted by the point sections on the adjusting rods, exceeds a certain value, the force limiting device including:

i) at least one coupling device which yields when stressed and is connected for movement with the adjusting rods, and ii) a transfer mechanism which converts movement of one of the first and second adjusting rods into a movement for unlocking the at least one locking tappet, c) a connecting piece, d) the adjusting rods being disposed coaxially to one another and having mutually facing ends supported at the connecting piece, and e) wherein:

i) the at least one locking tappet is held movably at the connecting piece, ii) the at least one coupling device includes a first coupling device that acts on the first adjusting rod via the connecting piece and yields only when stressed in one direction and a second coupling device that acts on the second adjusting rod via the connecting piece and yields only when stressed in an opposite direction, and iii) the transfer mechanism converts relative movement between the adjusting rods and the connecting piece into the unlocking movement, and iv) the at least one coupling device holds the end of a respective adjusting rod non-fixedly in contact with the connecting piece.

6. The apparatus of claim 5, wherein the transfer device includes:

a) catches mounted rigidly at the mutually facing ends of the adjusting rods, and b) a locking plate having:

i) stops which embrace the catches, and ii) a locking contour for the at least one locking tappet.

7. The apparatus of claim 6, a) further comprising a guiding ledge having a recess, and b) wherein:

i) the locking plate includes a locking contour, and ii) a the at least one locking tappet is held pivotably at the connecting part and, during a common movement with the connecting part and the adjusting rods is guided at the fixed guiding ledge so as to fall into the recess of the guiding ledge in one said end position and is locked in said recess by the locking contour of the locking plate.

8. The apparatus of claim 7, further comprising an elastic tensioning mechanism which prestresses the locking plate elastically in the respective end position on either side of a dead center position.

9. The apparatus of claim 6, further comprising an elastic tensioning mechanism which prestresses the locking plate elastically in the respective end position on either side of a dead center position.

10. An apparatus for mechanically locking the end Positions of first and second movable point sections, with first and second adjusting rods, with the first adjusting rod connected with the first point section and the second adjusting rod connected with the second point section, and the first and second adjusting rods coupled mechanically with one another, comprising:

a) two locking tappets for locking the adjusting rods in each case in one end position thereof, the two said locking tappets held immovably in the direction of movement of the adjusting rods at a part of the apparatus, said two locking tappets being fastened to the housing and being movable in a direction perpendicular to said direction of movement between a locking position, in which the two locking tappets lock the adjusting rods positively, and an unlocking position, which releases the adjusting rods, b) a force limiting device, which cancels the locking, when a force, exerted by the point sections on the adjusting rods, exceeds a certain value, the force limiting device including:

i) at least one coupling device which yields when stressed and is connected for movement with the adjusting rods, and ii) a transfer mechanism which converts movement of one of the first and second adjusting rods into a movement for unlocking the two locking tappets, the transfer mechanism having at least one unlocking ledge which extends parallel to the adjusting rods, is movable in a longitudinal direction thereof over inclined surfaces, and interacts with the locking tappets extending transversely to the locking ledges, c) a testing device which scans the position of movable shunt parts, and d) the locking tappets extend to the testing device and are held by the testing device in the unlocking position, when the testing device determines that the shunt parts have not been shifted correspondingly to the adjusting rods.

11. The apparatus of claim 10, a) further comprising a drivable carriage at which the at least one unlocking ledge is held, and b) wherein the adjusting rods, at mutually facing ends, have connecting parts, between which the coupling device is disposed, which yield when stressed in tension and which are engaged with clearance with the drivable carriage.

12. An apparatus for mechanically locking the end positions of first and second movable point sections, with first and second adjusting rods, with the first adjusting rod connected with the first point section and the second adjusting rod connected with the second point section, and the first and second adjusting rods coupled mechanically with one another, comprising:

a) two locking tappets for locking the adjusting rods in each case in one end position thereof, the two said locking tappets held immovably in the direction of movement of the adjusting rods at a part of the apparatus, said two locking tappets being fastened to the housing and being movable in a direction perpendicular to said direction of movement between a locking position, in which the two locking tappets lock the adjusting rods positively, and an unlocking position, which releases the adjusting rods, b) a force limiting device, which cancels the locking, when a force, exerted by the point sections on the adjusting rods, exceeds a certain value, the force limiting device including:

i) at least one coupling device which yields when stressed and is connected for movement with the adjusting rods, and ii) a transfer mechanism which converts movement of one of the adjusting rods into a movement for unlocking the two locking tappets, the transfer mechanism having at least one unlocking ledge which extends parallel to the adjusting rods, is movable in a longitudinal direction thereof over inclined surfaces, and interacts with the locking tappets extending transversely to the locking ledges, c) a drivable carriage at which the at least one unlocking ledge is held, and d) the adjusting rods, at mutually facing ends, have connecting parts, between which the at least one coupling device is disposed, which yield when stressed in tension and which are engaged with clearance with the drivable carriage.

* * * * *